US005495636A

United States Patent [19]

Dekker et al.

[11] Patent Number: 5,495,636

[45] Date of Patent: Mar. 5, 1996

[54] VACUUM CLEANER WITH INDEPENDENTLY OPERATING ON/OFF SWITCHES ON THE HANDLE AND THE MOTOR HOUSING

[75] Inventors: Jan H. Dekker; Bert P. Bultena, both of Hoogeveen, Netherlands

[73] Assignee: U.S. Philips Corporation, New York, N.Y.

[21] Appl. No.: 417,296

[22] Filed: Apr. 5, 1995

[30] Foreign Application Priority Data

Apr. 6, 1994 [EP] European Pat. Off. ..... 94200935

[51] Int. Cl.[6] ..... A47L 9/28

[52] U.S. Cl. ..... 15/339; 15/412

[58] Field of Search ..... 15/339, 319, 377, 15/412

[56] References Cited

U.S. PATENT DOCUMENTS

| | | | |
|---|---|---|---|
| 3,579,706 | 5/1971 | Hetland | 15/377 X |
| 3,588,943 | 6/1971 | Hetland | 15/377 X |
| 3,636,285 | 1/1972 | Wickham et al. | 15/339 X |
| 4,052,767 | 10/1977 | Dutcher | 15/377 |
| 5,301,385 | 4/1994 | Abe et al. | 15/339 X |
| 5,363,534 | 11/1994 | Dekker et al. | 15/339 |

FOREIGN PATENT DOCUMENTS 0574998 12/1993 European Pat. Off. .

*Primary Examiner*—Chris K. Moore
*Attorney, Agent, or Firm*—Ernestine C. Bartlett

[57] ABSTRACT

Vacuum cleaner is provided with independently operating on/off switches on the handle and the motor housing. A vacuum cleaner comprises a motor housing (2), which accommodates a suction motor (10) and a control unit (12) for controlling the suction motor (10), a hose 4, which can be coupled to the motor housing (2) and has a handle 8, a command switch (14) on the handle (8), for supplying a first on/standby command signal to the control unit (12), and a main switch (16) on the motor housing (2) for supplying a second on/standby command signal to the control unit (12). The command switch (14) and the main switch (16) operate independently of one another. As a result, the suction motor (10) can be switched on and off both at the handle (8) and at the motor (2) regardless of the position of the main switch (16).

7 Claims, 3 Drawing Sheets

VACUUM CLEANER WITH INDEPENDENTLY OPERATING ON/OFF SWITCHES ON THE HANDLE AND THE MOTOR HOUSING

BACKGROUND OF THE INVENTION

The invention relates to a vacuum cleaner comprising a motor housing, which accommodates a suction motor and a control unit for controlling the suction motor, a hose 4, which can be coupled to the motor housing and has a handle 8, a command switch on the handle, for supplying an on/standby command signal to the control unit, and a main switch on the motor housing. Such a vacuum cleaner is known from European Patent Application EP 0,574,998 A1, which corresponds substantially to U.S. Pat. No. 5,363,534. This known vacuum cleaner has remote control on the handle. The vacuum cleaner can be switched on and off by means of the command switch on the handle and the main switch on the motor housing. The command switch in the handle provides an on/standby function of the vacuum cleaner, the entire power supply of the vacuum cleaner being switched on and off by means of the main switch on the motor housing (a foot-operated switch).

A disadvantage of such a control system is that the main switch has to be actuated before the vacuum cleaner can be put into operation by means of the command switch. This is because the command switch and the main switch are functionally arranged in series. This is a nuisance to the user of the vacuum cleaner because two switches have to be actuated each time that the vacuum cleaner is to be put into operation.

SUMMARY OF THE INVENTION

It is an object of the invention to provide a vacuum cleaner with an improved ease of operation for the user. To this end, according to the invention, a vacuum cleaner of the type defined in the opening sentence is characterized in that the main switch is a switch for supplying a second on/standby command signal to the control unit.

The main switch on the motor housing now functions similarly to the command switch on the handle. A logic circuit then makes it possible to provide a switching function corresponding to the two-way switching arrangement for switching a light point in houses and the like by means of two two-way switches. The vacuum cleaner can now be switched on and off both by means of the command switch and by means of the main switch regardless of the position of the main switch.

The logic circuit can be constructed by means of a microprocessor or by means of digital electronic devices and discrete components. In view of this, a simple and effective embodiment of the vacuum cleaner is further characterised in that the control unit comprises a first monostable multivibrator for generating a first pulse in response to the command switch on the handle, a second monostable multivibrator for generating a second pulse in response to the main switch on the motor housing, a logic OR gate for supplying a combination signal in response to the first pulse and the second pulse, and a flip-flop for supplying an on/off command signal for switching on and switching off the suction motor in response to the combination signal.

In spite of the two-way switching function the user may yet be confronted with a vacuum cleaner which does not function if he forgets to connect the mains plug to the a.c. mains. In order to mitigate this inconvenience an embodiment of the vacuum cleaner in accordance with the invention is further characterized in that the vacuum cleaner further comprises an indicator for indicating a standby mode of the vacuum cleaner in response to the first and the second on/standby command signal. The standby indicator indicates to the user whether or not the vacuum cleaner is ready for operation. As a result, the use is able to understand more easily why the vacuum cleaner fails to function. The standby indicator may be arranged in the handle and/or on the motor housing and may be of any suitable visual or acoustic type. A more sophisticated embodiment of a vacuum cleaner in accordance with the invention is characterized in that the vacuum cleaner has a display with visual indicators for indicating the status of a plurality of operational functions of the vacuum cleaner and driving means for alternately activating the visual indicators in response to the first and the second on/standby command signal so as produce a moving light effect in a standby mode of the vacuum cleaner.

This method of driving the indicators of the display in the standby condition is very conspicuous and visibility is improved from a distance, for example when the indicators are situated on the motor housing. However, small the visibility of indicators, such as those required in view of the limited space in the handle, is also improved.

The display can be driven by means of a microprocessor or by means of discrete digital devices and components. In view of this, a simple and effective embodiment of the vacuum cleaner is further characterized in that the driving means comprise: a circulating shift register having bit cells operatively coupled to the visual indicators, and means for setting, when the standby mode begins, one of the bit cells to a value inverse to the other bit cells. The moving light effect is obtained by shifting a given bit pattern around in a digital shift register.

BRIEF DESCRIPTION OF THE DRAWINGS

These and other aspects of the invention will be described and elucidated with reference to the accompanying drawings, in which.

In these Figures like elements bear the same reference symbols.

DETAILED DESCRIPTION OF THE PREFERRED EMBODIMENTS

Figure 1:
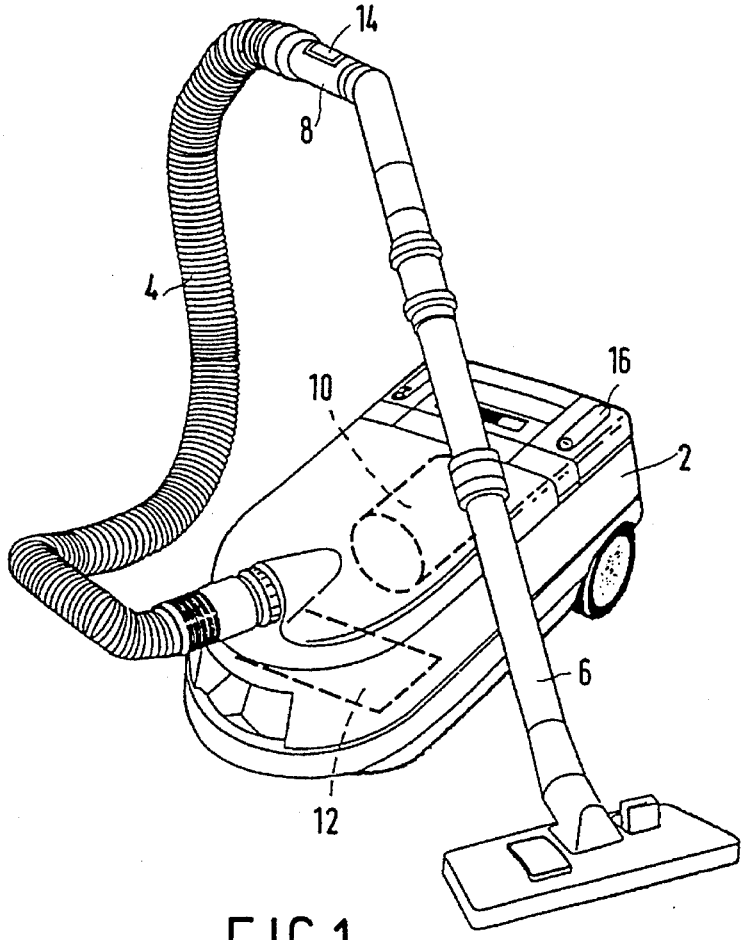
FIG. 1 shows a vacuum cleaner in accordance with the invention.

FIG. 1 shows a vacuum cleaner in accordance with the invention. A motor housing 2 is coupled to a suction tube 6 via a hose 4, which suction tube has a handle 8. The motor housing 2 accommodates a suction motor 10 and a control unit 12 for controlling the suction motor 10. The control unit 12 is coupled to a command switch 14 on the handle 8, which switch is connected to the control unit 12 by wires, not shown, in the hose 4. A foot-operated main switch 16 is mounted on the motor housing 16. The vacuum cleaner can be switched from a standby condition to an operating condition both by means of the command switch 14 on the handle 8 and by means of the main switch 16 on the housing. The standby condition is to be understood to mean an operating condition in which the suction motor 10 is in the off-state but in which opening voltage is applied from the a.c. mains to certain electrical parts, particularly to the control unit 12.

Figure 2:
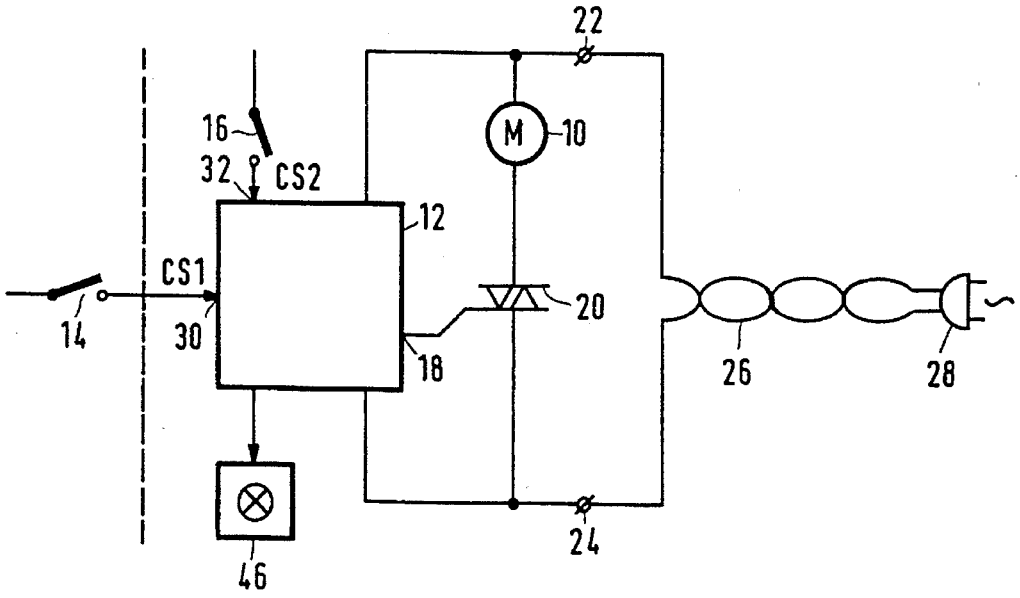
FIG. 2 is an electrical diagram to illustrate the operation of a vacuum cleaner in accordance with the invention.

FIG. 2 shows an electrical diagram of the vacuum cleaner in accordance with the invention. The control unit 12 has an output 18, which supplies an appropriate control signal to the control electrode of a triac 20, which in series with the suction motor 10 is arranged between a first a.c. terminal 22 and a second a.c. terminal 24, which terminals can be connected directly to the a.c. mains via a mains cord 26 and a mains plug 28. The control unit 12 is also connected to the first a.c. terminals 22 and the second a.c. terminal 24. The control unit 12 comprises rectifying means, not shown, to supply the electronic circuitry of the control unit 12 with a suitable direct voltage. The control unit 12 further has a first input 30 for receiving a first command signal CS1 from the command switch 14 and a second input 32 for receiving a second command signal 34 from the main switch 16. When the command switch 14 or the main switch 16 is pressed briefly the control unit 12 turns on the triac 20, as a result of which the suction motor 10 is started. If subsequently the command switch 14 or the main switch 16 is again pressed briefly the control unit 12 turns off the triac 20, as a result of which the suction motor 10 stops.

Figure 3:
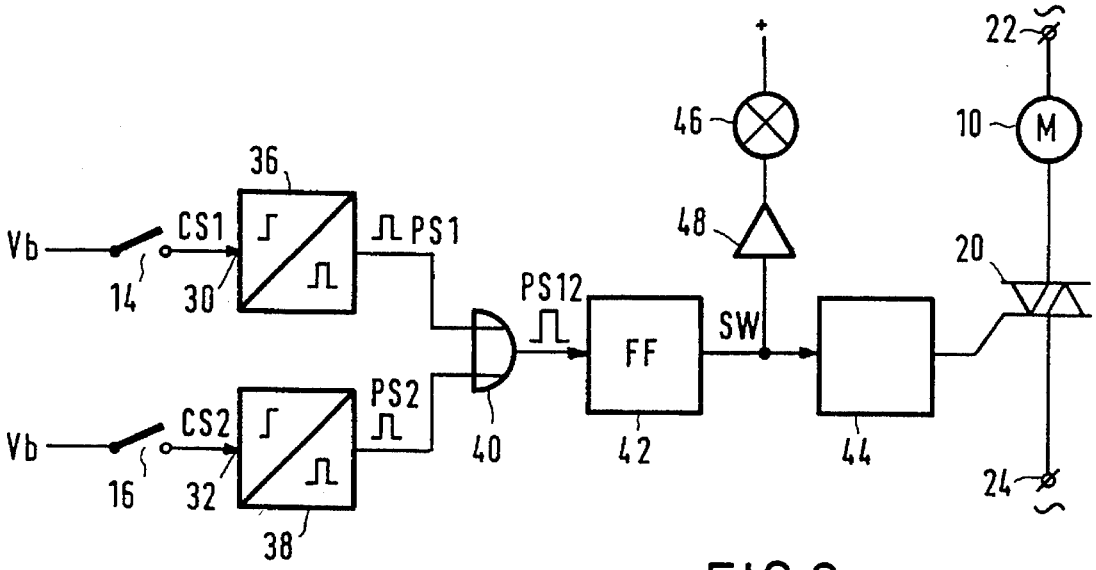
FIG. 3 shows an electrical diagram of a circuit for use in a vacuum cleaner in accordance with the invention.

FIG. 3 shows an electronic circuit for implementing the desired switching function. The first input 30 is the input of a first monostable multivibrator 36, also referred to as a one-shot, which generates a first pulse PS1 when the command switch 14 is closed briefly. The second input 32 is the input of a second monostable multivibrator 38, which produces a second pulse PS2 when the main switch 16 is closed briefly. For this purpose, the command switch 14 and the main switch 16 are connected to a suitable operating voltage Vb, which is supplied by the control unit 12 and which is applied to the command switch 14 on the handle 8 via wires in the hose 4. However, the command signals CS1 and CS2 may also be generated in another manner and reach the control unit 12 via a data bus. The first pulse PS1 and the second pulse PS2 are combined in a logic OR-gate 40 to form a combination signal PS12, which controls a flip-flop 42. The flip-flop 42 supplies an on/off command signal SW to an interface circuit 44, which drives the triac 20. The on/off command signal SW changes over upon each pulse of the combination signal PS12.

The standby mode can be indicated by an indicator 46, which is driven by the on/off command signal SW via a suitable driver stage 49. The indicator 46 can be mounted on the motor housing 2 or on the handle 8. In the case that the vacuum cleaner has a plurality of control functions, such as power control of the suction motor 10, and a display with a plurality of indicators for displaying the status of the control functions, such as the selected motor power, it is preferred to use the display indicators in order to indicate the standby mode.

Figure 4:
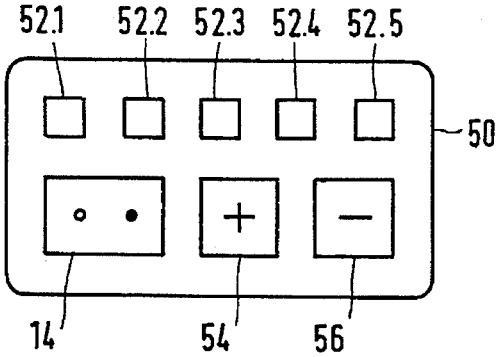
FIG. 4 shows a display and control keys for use in a vacuum cleaner in accordance with the invention.
Figure 5:
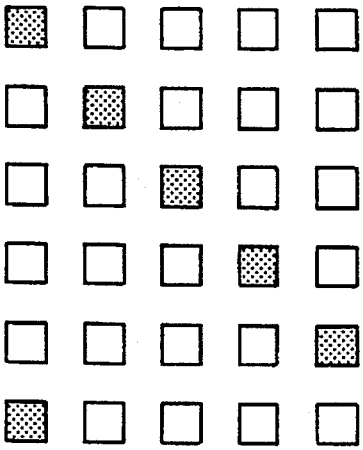
FIG. 5 is a diagram to illustrate the light effect of the display in the standby condition of a vacuum cleaner in accordance with the invention.

FIG. 4 shows an example of a display 50 mounted in the handle 8, which display has a plurality of indicators 52.1–52.5 for indicating the motor power, which can be increased with a key 54 and reduced with a key 56, which together with the command switch 14 are incorporated in the display 50. If the vacuum cleaner is now set to the standby mode with the command switch 14 on the handle 8 or with the main switch 16 on the motor housing 2, the indicators 52.1–52.5 are driven in turn so as to obtain a moving light effect, as is illustrated in FIG. 5. The indicator which lights up each time moves one position to the right and after the right-most indicator 52.5 the left-most indicator 52.1 will light up again. This results in a moving light effect. Obviously, the direction of movement may be reversed. Other variants are: (1) causing more than one indicator to light up at the same time and, conversely, (2) causing one or more indicators to be extinguished (moving gap). If desired, the indicators as well as the keys may also be arranged at a suitable location on the motor housing 2.

Figure 6:
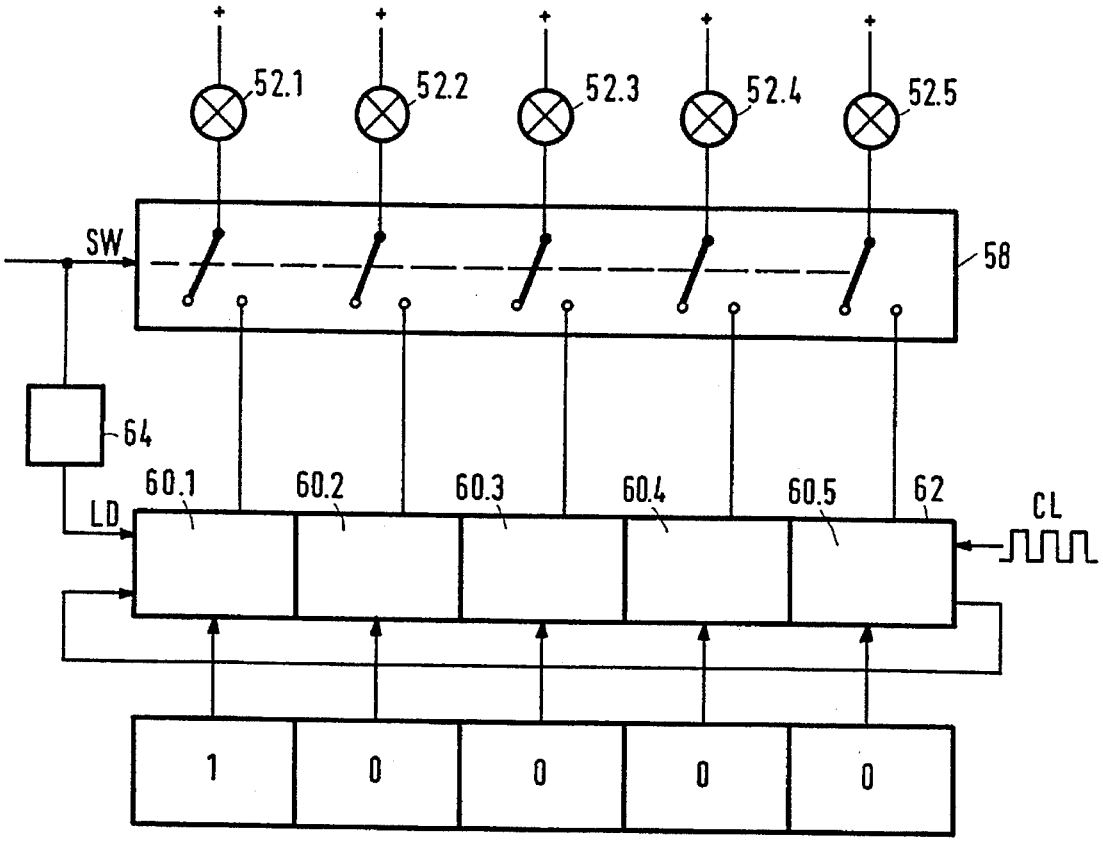
FIG. 6 is a block diagram of a driver circuit for the display of a vacuum cleaner in accordance with the invention.

FIG. 6 shows an electrical block diagram of a circuit for driving the indicators 52.1–52.5 so as to obtain a moving light effect in the standby mode. Under command of the afore-mentioned on/off command signal SW a selector 58 reads out the bit cells 60.1–60.5 of a circulating shift register 62. When the standby mode begins the bit cells 60.1–60.5 are loaded with a given bit pattern, for example 10000, under command of a load signal LD, which is supplied by an interface circuit 64 in response to the command signal SW. Subsequently, the content of the shift register 42 is shifted around with a clock pulse CL.

The display 50 can also be driven by means of a microprocessor having data inputs for scanning the state of the command switch 14 and the main switch 16 and control outputs for driving the display 50. The microprocessor is programmed so as to produce the desired moving light effect of the indicators 52.1–52.5 in the standby mode. A microprocessor is especially preferred particularly in those cases in which the microprocessor also controls the suction motor 10 and controls and monitors further operational functions of the vacuum cleaner.

We claim:

1. A vacuum cleaner comprising a motor housing (2), which accommodates a suction motor (10) and a control unit (12) for controlling the suction motor (10), a hose (4), which can be coupled to the motor housing (2) and has a handle (8), a command switch (14) on the handle (8), for supplying an on/standby command signal to the control unit (12), and a main switch (16) on the motor housing (2), wherein the main switch (16) is a switch for supplying a second on/standby command signal to the control unit (12).

2. A vacuum cleaner as claimed in claim 1, wherein in that the control unit (12) comprises a first monostable multivibrator (36) for generating a first pulse in response to the command switch (14) on the handle (8), a second monostable multivibrator (38) for generating a second pulse in response to the main switch (16) on the motor housing (2), a logic OR gate (40) for supplying a combination signal in response to the first pulse and the second pulse, and a flip-flop (42) for supplying an on/off command signal for switching on and switching off the suction motor (10) in response to the combination signal.

3. A vacuum cleaner as claimed in claim 2 wherein the vacuum cleaner further comprises an indicator (46) for indicating a standby mode of the vacuum cleaner in response to the first and the second on/standby command signal.

4. A vacuum cleaner as claimed in claim 2 wherein the vacuum cleaner has a display (50) with visual indicators (52.1–52.5) for indicating the status of a plurality of operational functions of the vacuum cleaner and driving means for alternately activating the visual indicators (52.1–52.5) in response to the first and the second on/standby command signal so as produce a moving light effect in a standby mode of the vacuum cleaner.

5. A vacuum cleaner as claimed in claim 1 wherein the vacuum cleaner further comprises an indicator (46) for indicating a standby mode of the vacuum cleaner in response to the first and the second on/standby command signal.

6. A vacuum cleaner as claimed in claim 1 or wherein the vacuum cleaner has a display (50) with visual indicators (52.1–52.5) for indicating the status of a plurality of operational functions of the vacuum cleaner and driving means for alternately activating the visual indicators (52.1–52.5) in response to the first and the second on/standby command signal so as produce a moving light effect in a standby mode of the vacuum cleaner.

7. A vacuum cleaner as claimed in claim 6, wherein the driving means comprise: a circulating shift register (62) having bit cells (60.1–60.5) operatively coupled to the visual indicators (52.1–52.5), and means (62) for setting, when the standby mode begins, one of the bit cells (60.1) to a value inverse to the other bit cells (60.2–60.5).

* * * * *